US006715740B2

(12) United States Patent
Engh et al.

(10) Patent No.: US 6,715,740 B2
(45) Date of Patent: Apr. 6, 2004

(54) FILL PACKS FOR USE IN HEAT AND MASS TRANSFER DEVICES

(75) Inventors: Ann L. Engh, Spencerville, OH (US); Herman P. Fay, Solana Beach, CA (US)

(73) Assignee: Sandkuhl Clay Works, Inc., Spencerville, OH (US)

( * ) Notice: Subject to any disclaimer, the term of this patent is extended or adjusted under 35 U.S.C. 154(b) by 0 days.

(21) Appl. No.: 10/302,237

(22) Filed: Nov. 22, 2002

(65) Prior Publication Data

US 2003/0071374 A1 Apr. 17, 2003

Related U.S. Application Data

(62) Division of application No. 09/517,390, filed on Mar. 2, 2000, now Pat. No. 6,517,058.

(51) Int. Cl.[7] ..... B01F 3/04

(52) U.S. Cl. ..... 261/112.1; 261/DIG. 11; 261/DIG. 72

(58) Field of Search ..... 261/112.1, 112.2, 261/113, DIG. 11, DIG. 72

(56) References Cited

U.S. PATENT DOCUMENTS

| | | | |
|---|---|---|---|
| 1,561,044 | A | 11/1925 | Alexander |
| 1,984,690 | A | 12/1934 | Nahigyan |
| 2,599,642 | A | 5/1952 | Boestad |
| 2,759,719 | A | 8/1956 | Odenthal |
| 2,917,292 | A | 12/1959 | Hittrich |
| 3,491,892 | A | 1/1970 | McCann |
| 3,739,556 | A | 6/1973 | Waters |
| 3,894,127 | A | 7/1975 | Fordyce |
| 4,052,491 | A | 10/1977 | Lefevre |
| 4,224,257 | A | 9/1980 | Robinson |
| 4,395,448 | A | 7/1983 | Lefevre et al. |
| 4,548,766 | A | 10/1985 | Kinney, Jr. et al. |
| 4,668,443 | A | 5/1987 | Rye |
| 4,701,287 | A | 10/1987 | Manteufel |
| 4,762,650 | A | 8/1988 | Bosman |

(List continued on next page.)

FOREIGN PATENT DOCUMENTS

| | | | |
|---|---|---|---|
| DE | 378621 | A | 7/1923 |
| DE | 710630 | A | 9/1941 |
| FR | 2134377 | A | 12/1972 |
| GB | 990851 | A | 5/1965 |
| SU | 638830 | A | 12/1978 |

*Primary Examiner*—Scott Bushey
(74) *Attorney, Agent, or Firm*—Baker & Daniels

(57) ABSTRACT

The present invention involves a fill formed of a plurality of plates that are pre-assembled into fill packs for application as fill media in cooling towers. A unique spacing and fastening system is employed to assemble individual plates into fill packs. The spacing system of the current invention utilizes a tube or rod which traverses apertures in the plates of the fill pack. The tube or rod is flattened or expanded in the area between the fill plates, thus locking the fill plates in place. The spacing system of the current invention provides substantially complete adjustability of the pitch of the fill plates. Alternatively, plate spacing can be effected by employing integral protrusions which bond to adjacent plates. The plates are designed to deploy a large amount of surface area in a compact volume and to allow free flow of fluids through the media. The plates utilize a ribbed structure which creates a relatively high strength-to weight ratio for the individual plates. The plate ribs slightly increase air flow turbulence and therefore heat transfer, while not adversely affecting flow velocity of the liquid to be cooled. Since flow velocity of the liquid to be cooled remains high, the plates of the current invention are low fouling. The plates can be employed in other applications such as trickle filters in wastewater plants or as catalyst carriers in chemical processes. In one exemplary embodiment, plates are made of ceramic material.

8 Claims, 7 Drawing Sheets

U.S. PATENT DOCUMENTS

| | | | | |
|---|---|---|---|---|
| 4,800,047 | A | | 1/1989 | Monjoie |
| 4,801,410 | A | | 1/1989 | Kinney, Jr. et al. |
| 5,013,492 | A | | 5/1991 | Gay et al. |
| 5,147,583 | A | | 9/1992 | Bugler, III et al. |
| 5,384,178 | A | | 1/1995 | Rye |
| 5,536,454 | A | | 7/1996 | Fujii et al. |
| 5,585,047 | A | | 12/1996 | Mortensen et al. |
| 5,632,934 | A | | 5/1997 | Billingham et al. |
| 5,851,636 | A | | 12/1998 | Lang et al. |
| 5,865,242 | A | | 2/1999 | Neri |
| 6,221,463 | B1 | | 4/2001 | White |
| 6,260,830 | B1 | * | 7/2001 | Harrison et al. |
| 6,293,528 | B1 | * | 9/2001 | Monkelbaan et al. |
| 6,460,832 | B1 | * | 10/2002 | Mockry et al. |
| 6,517,058 | B1 | * | 2/2003 | Engh et al. |

* cited by examiner

FILL PACKS FOR USE IN HEAT AND MASS TRANSFER DEVICES

RELATED APPLICATION

This is a Divisional of U.S. patent application Ser. No. 09/517,390, filed on Mar. 2, 2000, now U.S. Pat. No. 6,517,058.

BACKGROUND OF THE INVENTION

1. Field of the Invention

This invention relates to cooling towers and other direct contact heat and mass transfer devices utilizing fill media. More particularly, the invention relates to an improved film fill for use in cooling towers.

2. Description of the Related Art

Fill is the material over and through which fluids in heat and mass transfer devices flow. Cooling towers utilizing fill are constructed so that films of the liquid to be cooled flow over and coat the fill surfaces while the cooling medium flows through the fill. The liquid to be cooled and the cooling medium flow in different directions and directly contact each other.

Generally, the liquid to be cooled is sprayed over the fill, with the fill being contained within an enclosed space. The cooling medium, e.g., air, is supplied by means of a natural, induced, or forced draft. The draft may be horizontal (i.e., cross current) or vertical (i.e., counter current). The liquid to be cooled flows down, coating the fill, and directly contacts the counter or cross current cooling media. Generally, in counter current cooling, the air enters at the bottom of the tower and travels upward. In general, the greater the surface area of the liquid to be cooled contacting the cooling media, the more efficient the cooling tower will be.

Generally, such cooling towers include a housing through which air is admitted and exhausted by suitable means such as, e.g., exhaust fans. The liquid to be cooled (e.g., water) water) is distributed throughout the housing by a water distribution system (e.g., sprinklers) located above the fill. The water falls by gravity to a basin located at the base of the housing.

Fill can take many forms, including multi-cell blocks, multiple sheet configurations, and multiple plate configurations. Fills can also be made of many different materials including, but not limited to, plastics such as PVC, wood, metals, ceramics and fibrous cement.

Film fills should preferably exhibit the following characteristics:

1. Deploy a large surface area in a relatively small volume, thereby maximizing heat and mass transfer.
2. Allow air and water to pass over and through the fill pack and come into contact with each other with little airflow resistance.
3. Minimize the accumulation of solids, i.e., fouling of fill surfaces.
4. Provide a long service life, preferably in excess of 25 years.
5. Be inert to various water chemistries and insusceptible to UV damage.
6. Be able to withstand freeze-thaw cycling without damage.
7. Be able to operate at water temperatures in excess of 135° F. without loss of physical integrity or mechanical strength.
8. Be of rugged construction with the ability to withstand foot traffic on the top surface of the fill without damage or loss of shape.

9. Be non-flammable.
10. Be low in cost.
11. Be lightweight, thereby minimizing structural support requirements.
12. Be comprised of materials that are non-toxic, non-hazardous and suitable for easy and safe disposal at the end of service life.

Film fills currently utilized in cooling towers include multi-plate types comprised of asbestos-cement or fibrous cement plates, multi-sheet types comprised of plastic sheets, and ceramic multi-cell block types. Each of these fills exhibits a number of the aforementioned desirable characteristics while suffering from various drawbacks.

Multi-Plate Asbestos-Cement and Fibrous Cement Fills

Multiple vertically placed asbestos-cement or fibrous cement plates have been extensively employed in cooling towers as film fill. The plates are flat and rectangular, approximately 3/16 inch thick and are spaced in the range of ½ to 2 inches apart. Multiple layers of the plates are typically deployed in cooling towers, carried either directly on beams, or, alternatively, suspended from the beams.

These fills exhibit limitations with respect to service life, attack by various water chemistries and damage caused by freeze-thaw operation. They are also heavy and high in cost. Use of asbestos-cement fills is extremely problematic because they are hazardous and present disposal problems.

These plate type fills have straight top and bottom edges. If alternate layers are stacked parallel to each other in a cooling tower it becomes necessary to install special transverse spacers between layers to maintain separation and provide adequate structural support. The spacers also serve to minimize the flow restrictions occurring at the interface between layers. The parallel stacked arrangement is disadvantageous since internal mixing of the water and air flowing over and through the fill media can take place in one plane only, thereby diminishing the thermal performance of the fill. Additionally, extra costs are incurred relative to the supply and installation of the spacers.

If alternate layers are stacked at right angles to each other, good mixing of both air and water is promoted. However, air side pressure drop is significantly increased because of the restriction in cross-sectional area that occurs where alternate layers contact each other. Spacers between layers can be utilized to avoid the multiple restrictions at the layer to layer interfaces. This, however, increases the cost of the fill.

Fill plates of this type are relatively thick and are flat on both sides. The considerable thickness of the plates increases the size of the obstruction created at contact points, reduces cross sectional flow area and consequently increases air side pressure drop. The thickness of these fill plates additionally increases the weight of the fill with an attendant increase in structural costs. Air side pressure drop is detrimental to cooling tower efficiency since it necessitates increased power consumption to create adequate air velocity.

In some cases, plates of this type are assembled into multi-plate assemblies, also referred to as fill packs. In those cases, plastic spacer combs are utilized to join multiple plates to form a fill pack prior to installation in cooling towers. Assembly is accomplished by inserting combs through slotted openings in the plates and then rotating the combs by 90°. The spacer comb design has several shortcomings including the limited service life of the plastic comb material, reduction in strength at elevated temperatures and restrictions in available comb pitch settings.

Plate type fills made of asbestos-cement or fibrous cement absorb significant amounts of water when in service.

Absorption of water subjects plates of this type to freeze-thaw damage with an attendant decrease in useful service life. Additionally, the cementitious makeup of these plates and the use of cellulose fibers in fibrous cement precludes the use of these plates in certain water chemistries due to the reactive nature of these materials.

Multi-Sheet Plastic Fills

Multiple vertically placed plastic sheets are frequently employed in cooling towers as film fill. The sheet material most commonly used is polyvinyl chloride (PVC). The sheets are usually corrugated with the flute angle of the corrugations inclined typically about 60° from the horizontal. Adjacent sheets are cross-stacked with respect to each other so that the corrugations serve as a spacing means for the sheets. Other spacing configurations and sheet topographies are also employed depending on the application. The sheets are typically attached to each other with a bonding material at the locations where they contact each other thus forming fill packs. The sheets are very thin, typically in the range of 0.008 to 0.015 inches.

Multi-sheet assemblies formed of plastics such as PVC provide only a limited service life, are flammable, have low structural strength, and can present disposal problems. Additionally, plastic fills cannot be operated at high water temperatures, i.e., in excess of 135° F. without risk of structural deformation unless high temperature plastics such as CPVC are utilized. Use of high temperature plastics such as CPVC can result in as much as a doubling of fill costs. Fills of this type can be made rugged enough to withstand foot traffic on the top surfaces of the fill only if the fill sheet thickness is significantly increased. Such measures increase the cost of the fill. Due to the flammable nature of plastic fills, fire protection systems must, generally, be installed in cooling towers utilizing plastic fill. The cost of installing fire protection systems further increases the cost of utilizing plastic fill.

Integral spacing features between adjacent layers of fill have been employed in prior art plastic sheet fills, principally to reduce the fouling potential of the fill. The spacing features were created by alternately nesting longer and shorter sheets adjacent to each other. Such a structural configuration is disadvantageous since only every other sheet in the fill pack is load bearing, thus greatly increasing the contact stresses in the extremely thin sheets.

Individual plastic fill sheets are generally assembled into multi-sheet fill packs prior to installation in cooling towers by gluing or heat bonding select portions of the sheets together. These methods of joining plastic fill sheets have proved unreliable in many cases.

Ceramic Multi-Cell Blocks

Ceramic blocks stacked directly on top of each other, each typically 12 inches square and 6 inches tall, are also employed as film fill in cooling towers. The blocks are typically partitioned into multiple open 2 inch square cells with the cell walls being between ¼ and ⅜ of an inch thick. Water flows downward, coating the cell walls, and the cooling medium (air) flows upward through the cells counter-current to the water. The blocks are extruded in the wet clay stage and are then fired. The blocks are relatively heavy because of the thick cell walls that are demanded by the manufacturing process.

Due to material and process limitations, ceramic multi-cell blocks deploy a relatively small amount of surface area per unit volume, resulting in low heat transfer efficiency. The blocks are also very heavy due to the thick walled cell construction that is employed. These disadvantages severely limit the use of ceramic multi-cell blocks.

Providing a gap between adjacent layers of blocks has been found to be beneficial to reduce air side pressure drop. This has been accomplished by installing separate spacers between adjacent layers of flat sided blocks or by recessing most of the interior area of one side of the blocks. This has the disadvantage of removing significant surface area from a fill pack having an already low surface area. Another disadvantage of ceramic fill blocks is that the cellular configuration permits only vertically channeled flow thereby decreasing the mixing efficiency of the liquid to be cooled and the cooling medium.

What is needed in the art is a cooling tower fill which exhibits the aforementioned desirable attributes while being free of the disadvantages exhibited by the fill currently in use.

SUMMARY OF THE INVENTION

The fill plates of the present invention are comprised of ceramic material and are generally rectangular in configuration. The ceramic material of construction can be, e.g., cordierite, zirconia, alumina, mullite, porcelain, semi-porcelain, stoneware and earthenware. The fill plates of the current invention are assembled into multi-plate assemblies, also referred to as fill packs, utilizing novel spacer elements providing substantially unlimited freedom to set spacing, i.e., pitch distances between plates. The plates within a fill pack are arranged substantially parallel to each other with the spacing between plates being completely adjustable to allow optimization of performance. Individual plates employ a ribbed design which makes them relatively light-weight and yet strong. Individual plates also incorporate integral gapping features along the top and bottom edges of each plate which reduce the number of contact points between the layers of stacked fill packs and therefore minimize air side pressure drop through the fill media.

The invention, in one form thereof, comprises a fill pack suitable for use in cooling towers. The fill pack of this form of the current invention is comprised of a plurality of substantially planar plates. Incorporated in the plates is a matrix of integral interconnected ribs. The rib pattern can take many forms including a plurality of squares, rectangles, circles, or hexagons. Ribs also extend over the entire perimeter of the plates thus increasing the ruggedness of the plates. The width of the perimeter and interior ribs is, e.g., 0.25 inches and 0.12 inches respectively. The thickness of the ribs and interconnecting plate ligaments is, e.g., 0.12 and 0.06 inches respectively. The ribbed pattern may be incorporated on one or both sides of the plates. In addition to minimizing weight, the purpose of the ribs is to increase airflow turbulence, to increase the dwell time of the water in the fill zone and to promote uniform water distribution. All of these attributes increase heat transfer efficiency.

In one form of the present invention, each plate of the fill pack includes two opposing contact edges. The contact edges of each plate include a plurality of recessed portions. The recessed portions can be uniformly spaced on each contact edge.

In addition to the ribs, each plate incorporates a number of circular apertures that penetrate the plate on a generally uniform pattern. Each aperture is typically 0.375 inches in diameter and is reinforced by an integral circular rib. The fill pack of this form of the current invention further includes separate fixing devices which securely hold and space a number of plates apart from each other at a pre-selected distance, thus constituting a fill pack. The fixing devices are inserted through the plate apertures and include engagement portions that fix the plates at the desired spacing. In one form of the current invention, the engagement portion between plates comprise a flattened tube section. In an alternate form of the invention, the engagement portions comprise an expanded tube section. In one form of the current invention, the fixing device comprises a corrosion resistant metal tube, formed of, e.g., copper. In other forms of the current invention, the fixing device can be, e.g., formed of a solid plastic, e.g., polyvinyl chloride, rod or tube.

The invention, in another form thereof, comprises a method for forming a fill pack for use in a cooling tower. The method of this form of the current invention includes the steps of: placing a plurality of plates each of which has an aperture in a jig, traversing the apertures of the plates with a tube, and deforming the portions of the tube which occupy the space between adjacent plates.

In one form of the current invention, the step of deforming the portions of the tube between the plates comprises heating and applying compressive force to the portion of the tube to be deformed. In anther form of the current invention, this step can comprise the steps of: providing a swaging tool, and swaging the portions of the tube which are to be deformed. The swaging tool can be, for example, a hydraulic swaging tool.

An alternative method for creating fill packs from ceramic plates would be to replace the apertures with a number of integral protrusions (i.e., dimples) during manufacture. To assemble plates into fill packs, the protrusions on each plate would meet and bond with the next adjacent plate or opposing protrusion on the next adjacent plate. The depth of the protrusions could be varied to achieve the desired spacing between plates. The interface adhesion would be suitable epoxy or a ceramic to ceramic type bonding joined during the processing of the plates (i.e., glass adhesion). An epoxy bond, however, would have the same limitations as plastic materials in cooling tower service.

The invention, in another form thereof, comprises a method of placing a plurality of fill packs in a cooling tower. The method of this form of the current invention comprises the steps of: providing a plurality of fill packs, each of which is formed from a plurality of plates having a pair of periodically recessed edges; and placing alternate layers of fill packs at right angles to each other. This results in significantly fewer points of contact between layers and lower air flow resistance than would occur if the plates had straight edges.

Cooling towers may be of the counter-flow type where the cooling medium, e.g., air travels in a direction opposite to the descent of the water or of the cross flow type where the air travels in a direction transverse to the descent of the water. The improved film fill of this invention is applicable to both types of towers and is, in general, applicable to all types of towers in which water is to be cooled.

In addition to application in cooling towers, the improved fill of this invention is also applicable for use in other applications such as in trickle filters of water treatment plants where it can be employed to expose large amounts of wetted surface to flowing air to oxygenate the water and aid the digestion process.

An advantage of the present invention is the ability to substantially lessen the weight of plate type cooling tower fill while maintaining the desired strength of the fill.

Another advantage of the present invention is the ability to form multiple plate cooling tower fills with a plate-joining element which allows substantially complete adjustability of the spacing (i.e., pitch) between adjacent plates.

Yet another advantage of the present invention is the ability to lessen the points of contact between fill packs stacked one on top of the other, thus lessening air flow resistance and air side pressure drop through the fill.

A further advantage of the present invention is the ability to provide a fill structure which somewhat increases air flow turbulence in the fill pack, thereby increasing heat transfer efficiency.

Another advantage of the present invention is the ability to provide a fill pack that promotes uniformity of water distribution and which increases-the dwell time of the water within the fill pack.

Yet another advantage of the present invention is the ability to create fill packs having a high resistance to buckling.

Yet a further advantage of the present invention is the ability to create a ceramic fill having a high strength-to-weight ratio and low air flow resistance while maintaining the advantages of ceramic fills (i.e., low fouling, long life, inertness, ability to withstand freeze-thaw cycling without damage, ability to operate at high temperatures, and non-flammability).

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
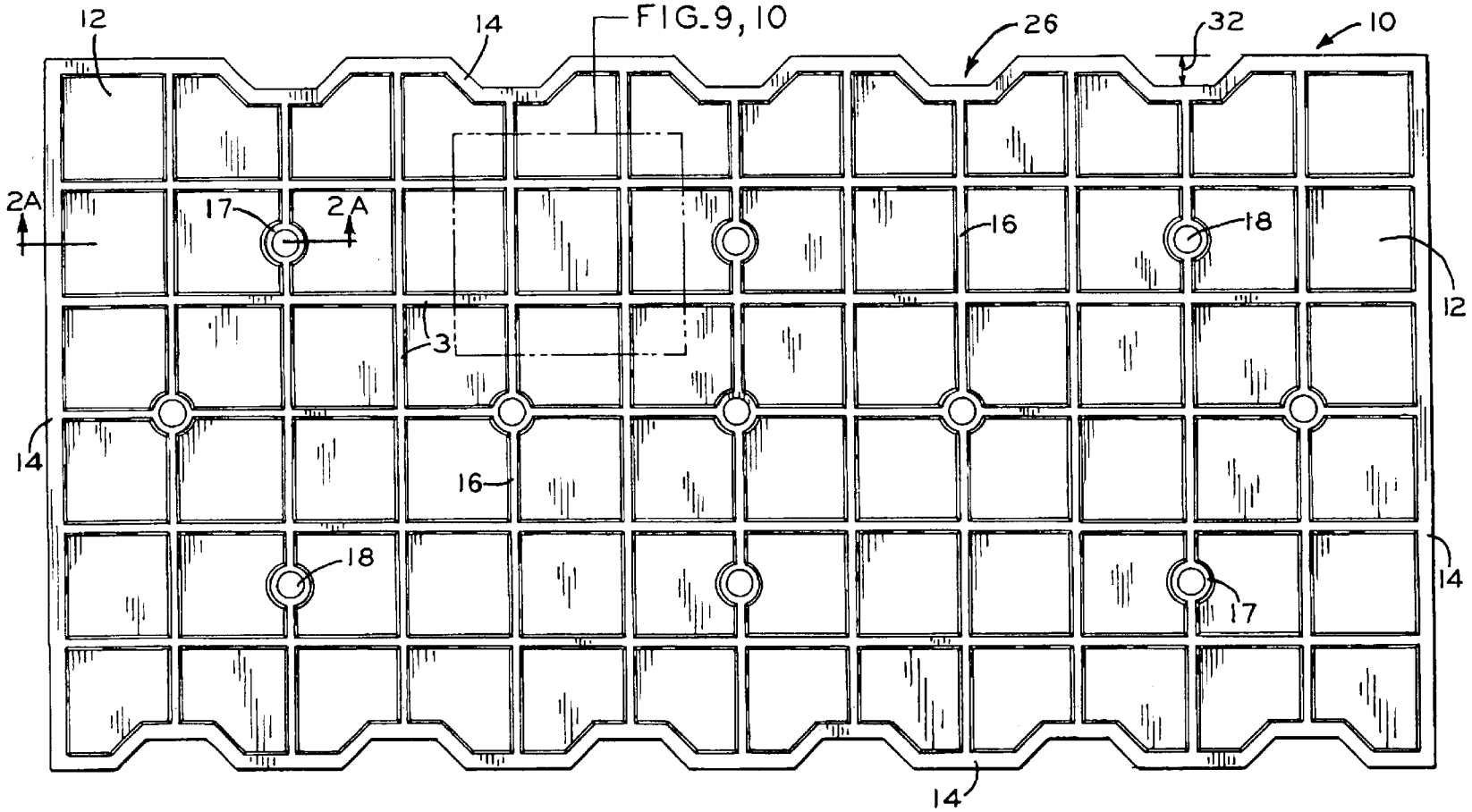
FIG. 1 is a side elevational view of a fill plate of the current invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, in several forms, and such exemplifications are not to be construed as limiting the scope of the invention in any manner.

DESCRIPTION OF THE PRESENT INVENTION

The embodiments disclosed below are not intended to be exhaustive or limit the invention to the precise forms disclosed in the following detailed description. Rather, the embodiments are chosen and described so that others skilled in the art may utilize their teachings.

Referring now to the drawings and particularly to FIG. 1, fill plate 10 is comprised of perimeter ribs 14, interior ribs 16 and ligaments 12. Ligaments 12 connect perimeter ribs 14 and interior ribs 16 to form fill plate 10. Annular interior ribs 17 surround apertures 18.

Figure 9:
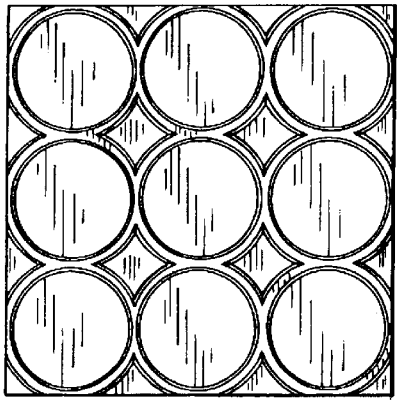
FIG. 9 is a partial side elevational view of an alternative embodiment of the fill plate of the current invention.
Figure 10:
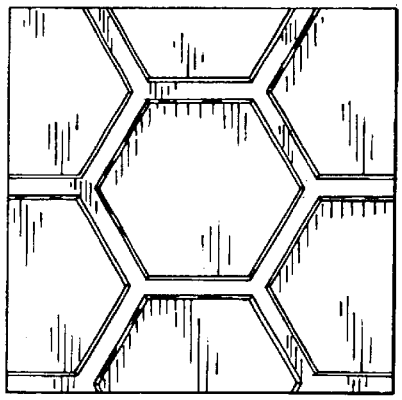
FIG. 10 is a partial side elevational view of yet another embodiment of the fill plate of the current invention.

Fill plate 10 is preferably rectangular in shape and in one embodiment has overall dimensions of 12" by 24". Fill plate 10 employs perimeter ribs 14 around its entire perimeter and interior ribs 16 throughout its interior to provide adequate strength and rigidity. In an exemplary embodiment, the width of the perimeter ribs is 0.25 inches, but other dimensions are also possible. FIG. 1 illustrates interior ribs 16 in a square pattern, but other patterns such as rectangular, hexagonal (FIG. 10) or round (FIG. 9) are also possible. In one embodiment, the square matrix pattern of interior ribs 16 is 1.8 inches×1.8 inches, but other dimensions are also possible. In one embodiment, the width of interior ribs 16 and exterior ribs 14 is 0.12 inches and 0.25 inches respectively, but other dimensions are also possible.

Perimeter ribs 14 and interior ribs 16 are interconnected by integral ligaments 12. In one embodiment, the thickness of ligaments 12 is 0.06 inches, but other dimensions are also possible. The ribbed design permits thin ligaments to be utilized, achieving a fill plate with a high strength to weight ratio when compared to existing fill plates formed of similar material. However, if required for special reasons such as developing additional buckling strength, the thickness of the ligaments 12 can be increased to a point where they equal the thickness of the ribs, thereby creating flat plate 10. The ribs increase air flow turbulence, thereby improving heat transfer. The horizontal portion of interior ribs 16 also act to promote uniform flow of water down the plates 10 thereby further promoting heat transfer efficiency. While ribs 14, 16, 17 account for a small amount of non-vertical flow, it does not sufficiently slow the water to create problems with fouling. In general, water flows vertically down fill plates 10 and maintains sufficiently high velocity to minimize solids entrained in the water from lodging on the plate surfaces, (i.e., fouling).

Figure 2A:
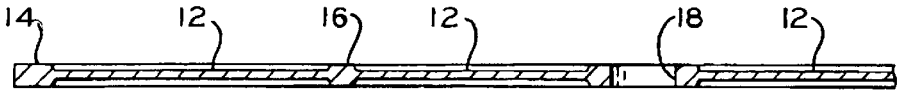
FIG. 2A is a sectional view taken along line 2A, 2A of FIG. 1.
Figure 2B:
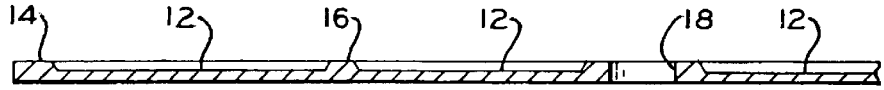
FIG. 2B is a sectional view of an alternative embodiment of the current invention.

FIG. 2A illustrates a cross-section of fill plate 10 taken along line 2A—2A of FIG. 1. As illustrated, perimeter ribs 14 and interior ribs 16 form protrusions on either side of ligaments 12. In another embodiment of the present invention, illustrated in FIG. 2B, perimeter ribs 14 and interior ribs 16 form protrusions on only one side of ligaments 12.

Figure 8:
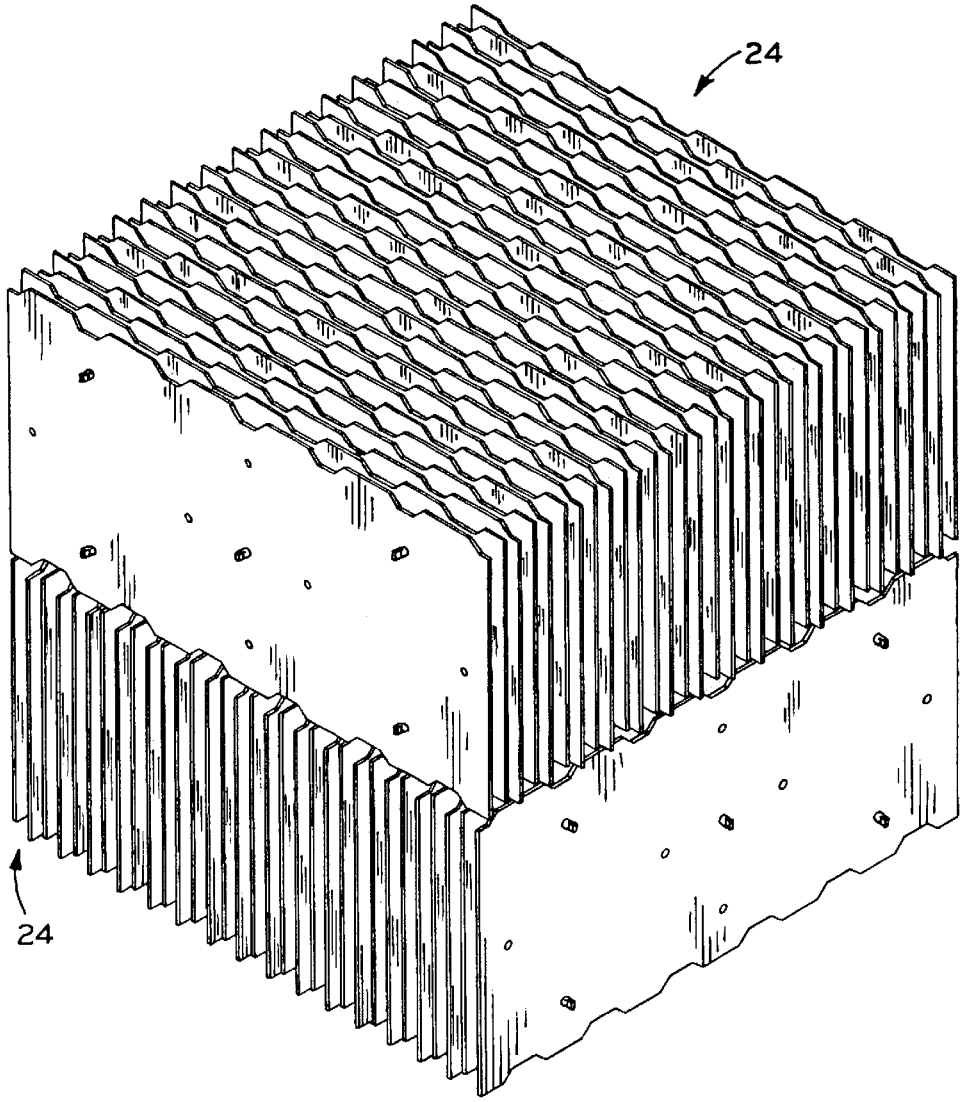
FIG. 8 is a perspective view of a plurality of stacked fill packs constructed in accordance with the teachings of the current invention.

As illustrated in FIG. 1, fill plate 10 includes contact edges having recesses 26. Recesses 26 are uniformly spaced along the contact edges of fill plate 10. In one embodiment, the depth 32 of recesses 26 is 0.5 inches, but other dimensions are also possible. The pattern of recesses 26 is staggered with respect to the top and bottom edges of the plate as illustrated in FIG. 1. Recesses 26 create gaps between layers when fill packs formed of a plurality of fill plates 10 are stacked at right angles to one another. Recesses 26 also minimize the contact points between vertically adjacent fill plates when stacked at right angles to each other, as shown in FIG. 8. This minimizes the flow restriction between layers and also eliminates the need for separate spacers.

Fill plate 10 incorporates a number of apertures 18 that are reinforced by annular ribs 17. In the embodiment illustrated in FIG. 1, eleven apertures 18 are incorporated per plate. The number of apertures 18 can be increased or decreased depending upon the size and/or intended application of the fill plate. In one embodiment, the diameter of apertures 18 is 0.375 inches, but other dimensions are also possible.

The material employed for fill plate 10 is a vitrified alumino-silicate ceramic. This makes the plate highly inert, dimensionally stable, non-flammable, extremely durable, capable of operating at high temperatures, virtually non water absorbing (less than 0.1%), non-toxic and non-hazardous with respect to disposal at the end of service life. Ceramic materials that can be used in accordance with the teachings of the present invention include, e.g., codierite, zirconia, alumina, mullite, porcelain, semi-porcelain, stoneware and earthenwarc. Although one exemplary embodiment utilizes a vitrified ceramic, other materials such as plastics and metals also could be employed.

Figure 3A:
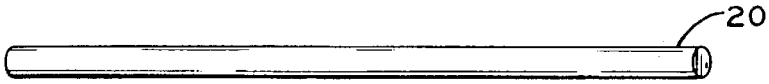
FIG. 3A is a perspective view of a joining rod of the current invention.

Multiple fill plates 10 are securely held in position in the final assembly by deformable rods 20 (FIG. 3A) or deformable tubes 22, (FIG. 3B) the maximum number of which can be employed equal the number of apertures 18 incorporated in each plate. Deformable rods 20 or deformable tubes 22 serve as fixing devices for the final assembly. First, the fixing devices position and fix individual plates, of a fill pack to each other and First, the fixing devices position and fix individual plates, of a fill pack to each other and form a unitary assembly. Second, they maintain buckling loads induced by the compressive loads of the multi-layer fill pack system in individual plates within allowable limits.

The rods or tubes rigidly fix adjacent plates at specific locations within the fill pack. This controls the slenderness ratio of the individual plates, which are acting as columns, thereby maintaining buckling loads within allowable limits. The number of tubes or rods utilized in a particular fill pack to control buckling loads may be varied depending upon the magnitude of the compressive loads individual plates are subjected to. Thus, fill packs located in the lower portion of a multi-layer fill pack system may employ more tubes or rods than those near the top. The ability to control the slenderness ratio of individual plates allows high compressive loads to be safely applied to the fill packs. This feature of the current invention permits installation of very deep fill zones in cooling towers without requiring multiple layers of fill pack support beaming.

Figure 3B:
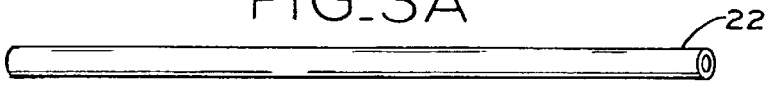
FIG. 3B is a perspective view of a joining tube of the current invention.
Figure 5:
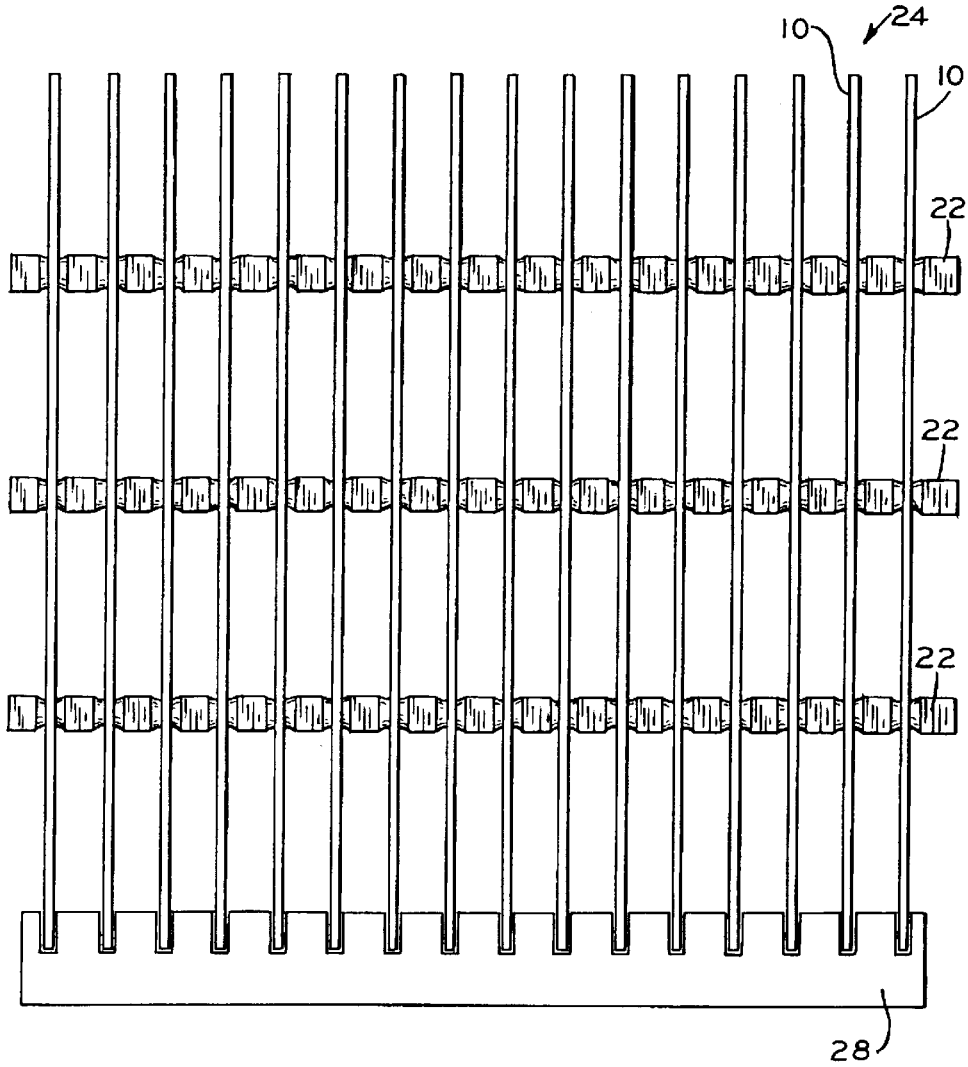
FIG. 5 is an end elevational view of a fill pack of the current invention after deformation of the joining tube.

A typical deformable tube 22 is shown in FIG. 3B. Deformable tubes 22 are, in one exemplary embodiment, made of copper or some other corrosion resistant metal. Assembly into fill packs proceeds by first placing a number of individual fill plates 10 into an assembly jig 28 as illustrated in FIG. 5. Jig 28 holds the individual fill plates 10 in the desired configuration and maintains the individual fill plates in the desired spaced-apart relationship.

Figure 7A:
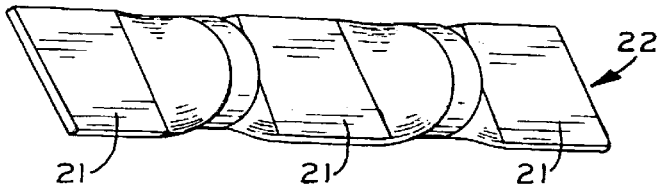
FIG. 7A is a perspective view of a deformed joining tube of the current invention.
Figure 4:
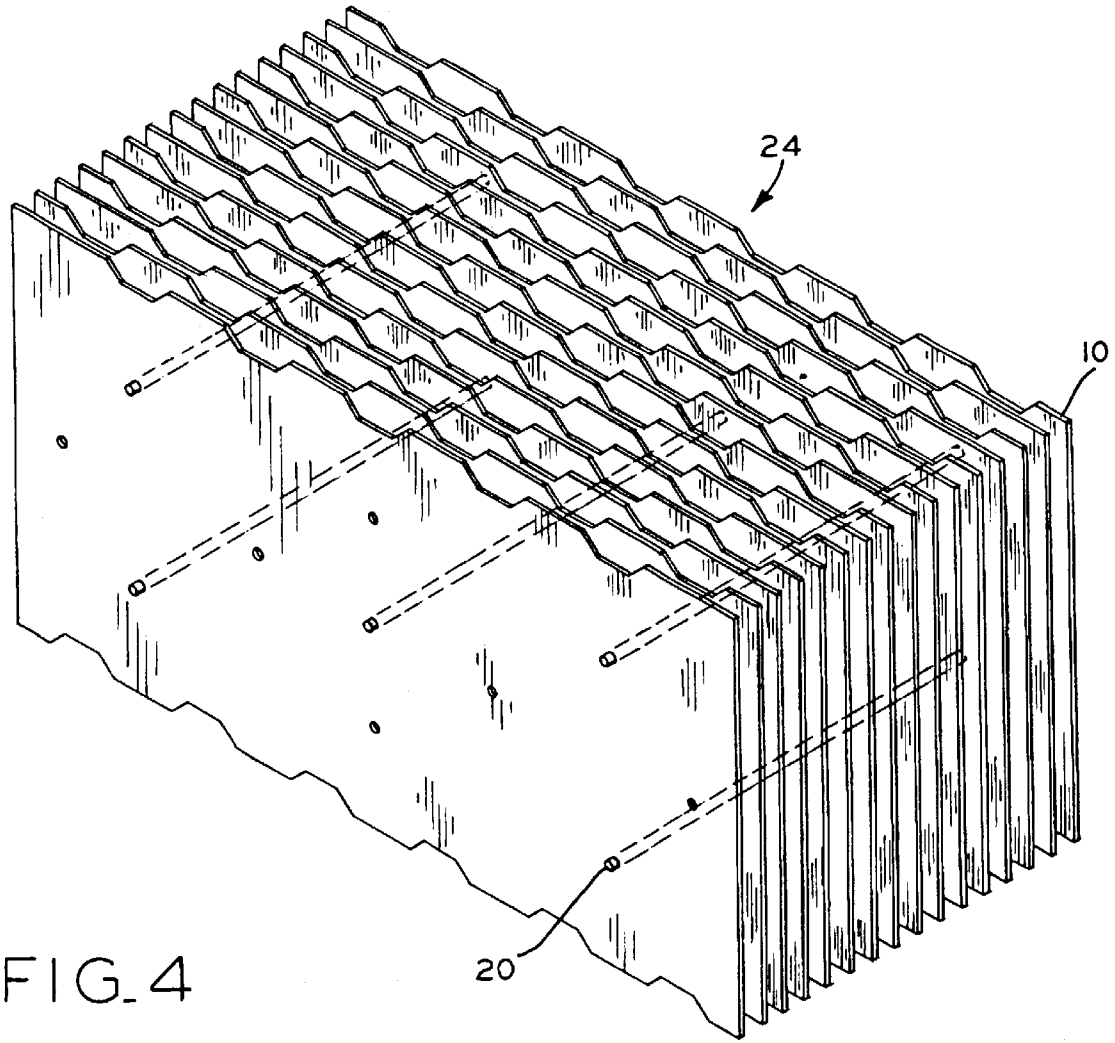
FIG. 4 is a perspective view of a fill pack of the current invention prior to deformation of the joining tubes.
Figure 7B:
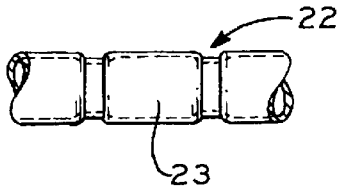
FIG. 7B is a top elevational view of an expanded joining tube.

Fill plates 10 are alternately placed into jig 28 with the recess pattern on the top and bottom edges of the plates alternating as illustrated in FIG. 4. Next, a number of deformable tubes 22 are inserted through apertures 18 (FIG. 1) as shown in FIG. 4. After the deformable tubes 22 are inserted through apertures 18, the portions of deformable tubes 22 occupying the spaces between fill plates are flattened. FIG. 7A illustrates deformable tubes 22 with flattened sections 21. The flattening of deformable tubes 22 is accomplished by a swaging tool sized for use between plates 10, thereby forming a completed fill pack 24. The deformation of the tubes 22 squeezes each plate from both sides and permanently locks it in position as shown in FIG. 5. As illustrated in FIG. 7B, tubes 22 may also be deformed by expanding sections 23 located between adjacent plates.

Figure 6:
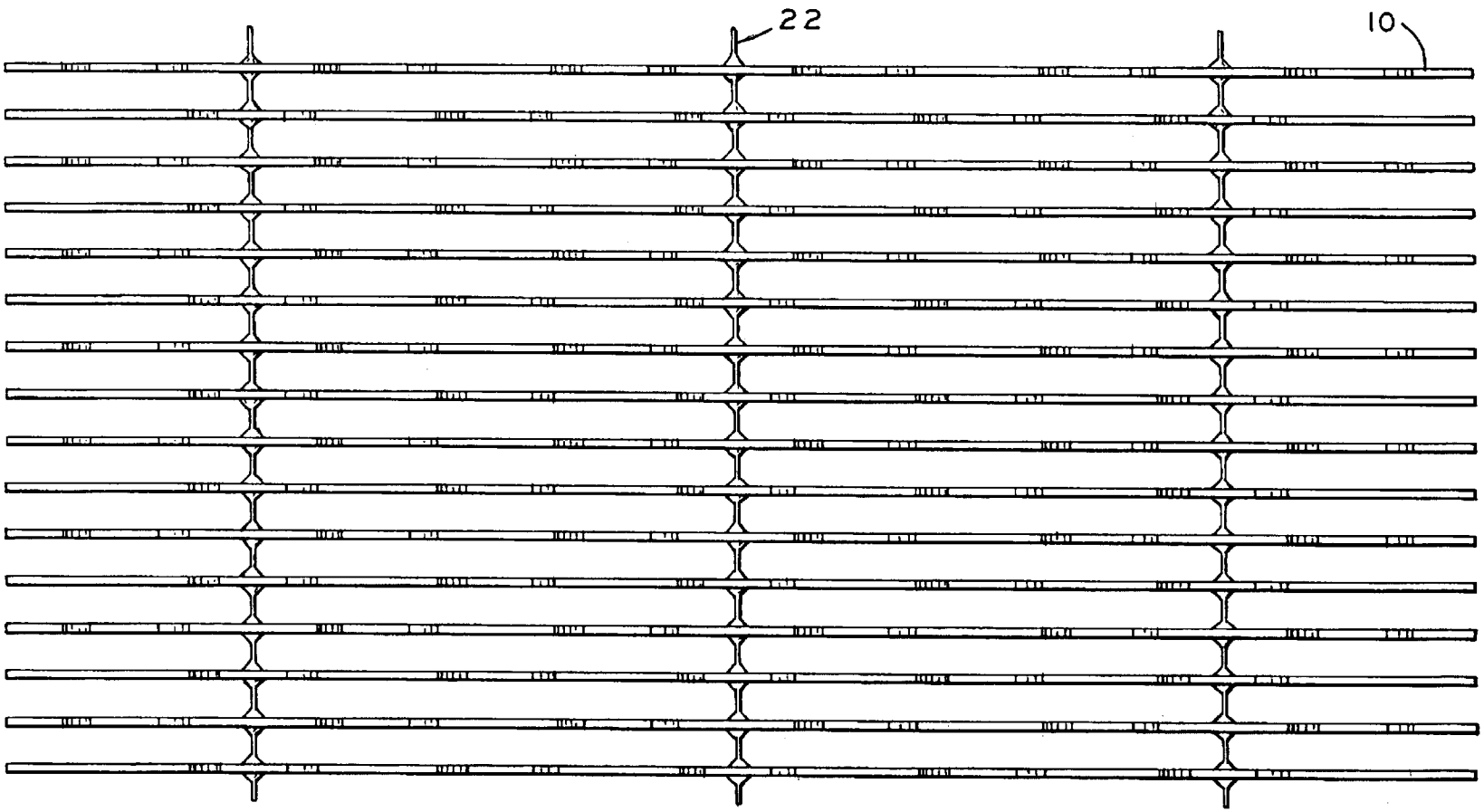
FIG. 6 is a top elevational view of the fill pack of FIG. 5.

FIG. 6 illustrates a top elevational view of fill pack 24. As illustrated, deformable tubes 22 are flattened such that the narrowest portion of the flattened tube faces the source of the fluid to be cooled, thus minimizing fluid flow resistance. The tube spacing and positioning system of the current invention allows easy and rapid assembly of the fill plates at the desired plate spacing required for optimum fill performance.

In one exemplary embodiment, the fixing devices comprise tubes or solid rods made of thermoplastic materials such as PVC. In this case the tubes or rods are inserted through the plates holes and then flattened employing a heated plier like tool which causes the plastic material to permanently deflect or flow and lock the plates into position in a manner similar to the metallic tubes. This type of spacing element however suffers from the same material limitations as noted for the plastic spacer combs employed in prior art but does not limit the available plate spacings as with spacer combs.

Figure 12B:
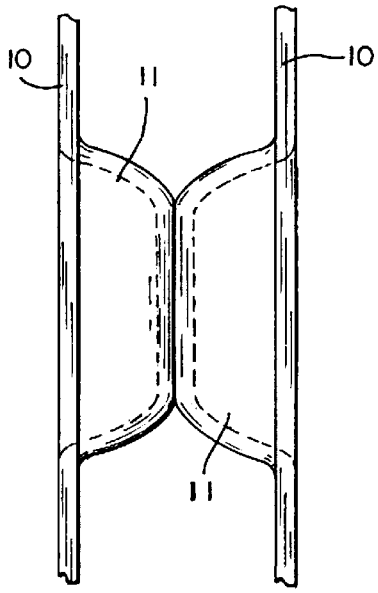
FIG. 12B is a top elevational view of a protrusion bonded to an opposing protrusion of an adjacent plate.
Figure 12A:
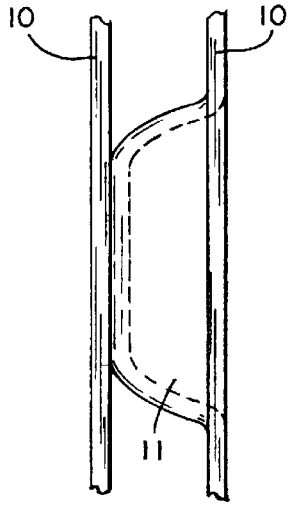
FIG. 12A is a top elevational view of a protrusion bonded to an adjacent plate.

In one exemplary embodiment, fill plates 10 include integral protrusions 11 as illustrated in FIGS. 12A and 12B. In this embodiment, protrusions 11 would meet and bond with the next adjacent plate or an opposing protrusion 11 on the next adjacent plate. Spacing between fill plates 10 could be varied by utilizing larger or smaller protrusions as necessary.

A typical fill pack may be comprised of 16 plates and have outside dimensions of 12 inches wide×12 inches high×24 inches long. Other plate quantities and dimensions are also possible depending on the application. In one embodiment, completed fill packs 24 are installed in the fill zone of a cooling tower in cross stacked fashion as shown in FIG. 8. When stacked in this manner a gap is automatically created between alternate layers by virtue of the recess pattern incorporated in the top and bottom edges of the fill plates and by the staggered method of assembling individual plates in a fill pack. The integrally gapped design of the fill pack system results in minimum flow restriction at the interfaces between adjacent layers in the fill zone of the cooling tower and therefore improves thermal performance.

Figure 11:
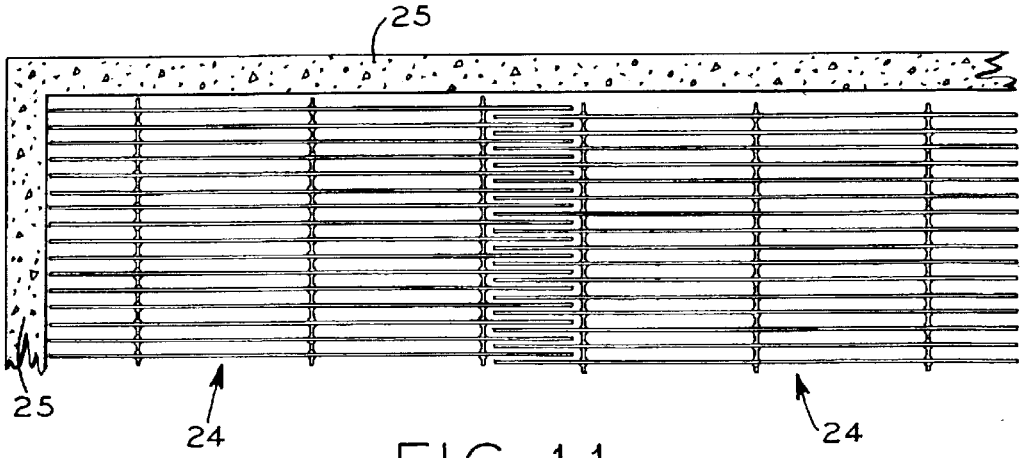
FIG. 11 is a top elevational view of the plates of one fill pack occupying the spaces between the plates of another fill pack.

Cooling tower cells are normally square or rectangular in cross-section. When installing fill packs into cells it is important to have each layer completely fill the cell with as little gap between fill packs and cell walls as possible in order to avoid air or water bypass around the fill. The structure and arrangement of the fill of this invention permits wall to wall installation of the fill packs with minimal gap. To minimize the gap in the transverse direction of the fill packs, the number of plates in one of the fill packs can be increased or decreased as required and/or the pitch of the fill packs can be adjusted. Additionally, to minimize the gaps in the longitudinal direction of the fill packs they may be stacked such that the plates of one fill pack occupy the spaces between plates of another fill pack as illustrated in FIG. 11. In this way, the fill of the current invention can be loaded into new cells or cells to be retrofitted with minimal gap between fill 24 and the cell walls 25.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A fill pack for use in a cooling tower, comprising:

a plurality of plates, each of said plates having an aperture; and a unitary fixing device, said fixing device traversing a plurality of said apertures, said fixing device having engagement portions contacting said plates, said engagement portions comprising a deformed portion of said fixing device whereby said engagement portions maintain said plates in spaced apart relationship.

2. A fill pack for use in a cooling tower, comprising:

a plurality of plates, each of said plates having an aperture; and a unitary fixing device, said fixing device traversing a plurality of said apertures, said fixing device having engagement portions contacting said plates, whereby said engagement portions maintain said plates in spaced apart relationship, and wherein said engagement portion comprises a flattened tube portion.

3. The fill pack as recited in claim 1, wherein said plates are formed of a vitrified alumino-silicate ceramic.

4. The fill pack as recited in claim 1, wherein said fixing device comprises a corrosion resistant metal tube.

5. The fill pack as recited in claim 4, wherein said corrosion resistant metal is copper.

6. The fill pack as recited in claim 1, wherein said fixing device comprises a solid plastic rod.

7. The fill pack as recited in claim 1, wherein said fixing device comprises a plastic tube.

8. The fill pack as recited in claim 1, wherein said engagement portion comprises a flattened tube portion.

* * * * *